US006700560B2

(12) United States Patent
Sumiya

(10) Patent No.: US 6,700,560 B2
(45) Date of Patent: Mar. 2, 2004

(54) LIQUID CRYSTAL DISPLAY DEVICE

(75) Inventor: Takanori Sumiya, Tokyo (JP)

(73) Assignee: NEC LED Technologies, Ltd., Kanagawa (JP)

( * ) Notice: Subject to any disclaimer, the term of this patent is extended or adjusted under 35 U.S.C. 154(b) by 145 days.

(21) Appl. No.: 09/866,833

(22) Filed: May 30, 2001

(65) Prior Publication Data

US 2002/0000964 A1 Jan. 3, 2002

(30) Foreign Application Priority Data

May 30, 2000 (JP) ..... 2000-160804

(51) Int. Cl.[7] ..... G09G 3/36

(52) U.S. Cl. ..... 345/88; 345/84; 345/87; 345/89; 345/90; 345/94; 345/98; 345/101

(58) Field of Search ..... 345/84, 87, 88, 345/89, 90, 94, 98, 101

(56) References Cited

U.S. PATENT DOCUMENTS 4,096,523 A * 6/1978 Belmares-Sarabia et al. ..... 358/520
4,153,911 A * 5/1979 Isono et al. ..... 348/189
4,250,522 A * 2/1981 Seki et al. ..... 358/527
5,489,918 A * 2/1996 Mosier ..... 345/89
5,936,604 A * 8/1999 Endou ..... 345/101
6,518,946 B2 * 2/2003 Ode et al. ..... 345/98

FOREIGN PATENT DOCUMENTS

| | | |
|---|---|---|
| JP | 2-185176 | 7/1990 |
| JP | 4-60583 | 2/1992 |
| JP | 200-10532 | 1/2000 |
| JP | 2000-98343 | 4/2000 |

* cited by examiner

*Primary Examiner*—Bipin Shalwala
*Assistant Examiner*—Vincent E. Kovalick
(74) *Attorney, Agent, or Firm*—Young & Thompson

(57) ABSTRACT

Provided is a liquid crystal display device capable of independently adjusting gradation for each of RGB. A control circuit outputs a clock signal, an image signal for each of RGB, and an adding circuit control signal. A gradation voltage generation circuit outputs a gradation voltage. A color correction voltage for each of RGB is generated in a color correction voltage generation circuit based on an input signal for color correction. A signal electrode drive circuit receives the clock signal, a control signal, the image signal, the adding circuit control signal, the gradation voltage, and the color correction voltage. A gradation voltage corresponding to a gradation value of the image signal for each of RGB is selected from the gradation voltage. The color correction voltage for each of RGB is added to the gradation voltage, then a sub-pixel data signal is generated and sent to a liquid crystal panel.

5 Claims, 15 Drawing Sheets

| control signal S40B | vertical-stripe type | | | mosaic type | | | horizontal-stripe type | | |
|---|---|---|---|---|---|---|---|---|---|
| horizontal line | Yi | Yi+1 | Yi+2 | Yi | Yi+1 | Yi+2 | Yi | Yi+1 | Yi+2 |
| VA | R | R | R | R | B | G | R | G | B |
| VB | G | G | G | G | R | B | R | G | B |
| VC | B | B | B | B | G | R | R | G | B |

| | | | | | |
|---|---|---|---|---|---|
| R | G | B | R | G | B |
| R | G | B | R | G | B |
| R | G | B | R | G | B |
| R | G | B | R | G | B |
| R | G | B | R | G | B |

vertical stripe

| | | | | | |
|---|---|---|---|---|---|
| R | G | B | R | G | B |
| B | R | G | B | R | G |
| G | B | R | G | B | R |
| R | G | B | R | G | B |
| B | R | G | B | R | G |

mosaic triangle

LIQUID CRYSTAL DISPLAY DEVICE

BACKGROUND OF THE INVENTION

1. Field of the Invention

The present invention relates to a liquid crystal display device for color displaying. For example, the present invention relates to the liquid crystal display device for the color displaying with a liquid crystal panel having color filters of a vertical-stripe type, a mosaic type or a like built therein, and capable of adjusting white balance of a display screen thereof.

The present application claims priority of Japanese Patent Application No.2000-160804 filed on May 30, 2000, which is hereby incorporated by reference.

2. Description of the Related Art

As shown in FIG. 18, a conventional liquid crystal display device includes: a liquid crystal panel 1, a signal electrode drive circuit 2, a scanning electrode drive circuit 3, and a control circuit 4. The liquid crystal panel 1 includes color filters where a pixel is divided into sub-pixels of three primary colors of RGB (Red, Green, Blue). The liquid crystal panel 1 also includes: a plurality of data signal lines X1, . . . , Xn for receiving a sub-pixel data signal D2 corresponding to the sub-pixels of RGB, a plurality of scanning signal lines Y1, . . . , Ym for receiving a scanning signal V3, and a plurality of sub-pixel regions provided at points where each of the data signal lines X1, . . . , Xn and each of the scanning signal lines Y1, . . . , Ym intersect. The sub-pixel data signal D2 is supplied to sub-pixel regions selected from the plurality of sub-pixel regions by a scanning signal V3, and thus a color image corresponding to the sub-pixel data signal D2 is displayed.

The signal electrode drive circuit 2 receives a clock signal ck, a control signal Ct, an image signal V4 for each of RGB, and a central voltage Vs1, generates the sub-pixel data signal D2 by selecting a gradation voltage corresponding to a gradation value of the image signal V4 for each of RGB, and sends the sub-pixel data signal D2 to each of the data signal lines X1, . . . , Xn of the liquid crystal panel 1. The scanning electrode drive circuit 3 sends the scanning signal V3 to each of the scanning signal lines Y1, . . . , Ym of the liquid crystal panel 1 synchronously with the clock signal ck. The control circuit 4 outputs the clock signal ck, the control signal Ct, the image signal V4, and the central voltage Vs1.

FIGS. 19(*a*), 19(*b*), and 19(*c*) are exemplary views showing the above-mentioned color filters used in the liquid crystal panel 1.

The color filter of a vertical-stripe type shown in FIG. 19(*a*) is suitable for displaying characters, drawings, and the like. The color filters of a mosaic type and a triangle type shown in FIG. 19(*b*), and 19(*c*) are ones where the three primary colors of RGB are arranged in a delta state such as stacked-up bricks, which are suitable for displaying moving images such as television (that is, picture data displaying). There is also a horizontal-stripe type color filter. In the horizontal-stripe type color filter, a horizontal line is constituted of pixels of one of the RGB colors, and a line in the vertical direction is constituted of pixels of the three primary colors of RGB.

Adjustment of white balance of a display screen is generally performed by limiting a range of a gradation value of an image signal for each of RGB to be used. For example, in the case where the gradation value of each of RGB is represented by 8-bit data, the gradation value could take values in a range of from 0 to 256. In adjusting the white balance, however, top and bottom of the gradation value of a particular color are cut. For example, regarding the gradation value for R, 0 to 4 and 251 to 255 are cut, and thus the gradation value of 5 to 25 is used. In addition, regarding the gradation value for G and the gradation value for B, 0 to 255 is used.

In adjusting the white balance, as a method of adjusting the gradation voltage for each of RGB without adjustment of the gradation value for each of RGB, there exists a method described in Japanese Patent Laid-open No. Hei4-60583 gazette (hereinafter, referred to as a literature), for example.

FIG. 20 is a circuit diagram showing an electrical configuration of the signal electrode drive circuit 2 described in the foregoing literature.

The signal electrode drive circuit 2 includes: a serial/parallel conversion circuit 2*a*, decoders 2*b*1, . . . , 2*bn*, a color selection circuit 2*c*, and selection circuits 2*d*1, . . . , 2*dn*. The serial/parallel conversion circuit 2*a* receives the clock signal ck, the control signal Ct and the image signal V4, and outputs gradation values V2*a*1, . . . , V2*an* for each of RGB of the image signal V4. The decoders 2*b*1, . . . , 2*bn* decode the gradation values V2*a*1, . . . , V2*an*, and output selection signals S2*b*1, . . . , S2*bn* corresponding to the gradation values V2*a*1, . . . , V2*an*. The color selection circuit 2*c* selects voltages VA, VB, and VC for adjusting the gradation voltage for each of RGB, which are supplied to selected terminals A to C, for every horizontal line period of an image of the liquid crystal panel 1 (FIG. 18) based on a color selection signal CS, and outputs a voltage V2*c*. The selection circuits 2*d*1, . . . , 2*dn* receive drive voltages V1, . . . , Vq generated by a voltage dividing resistor connected between the voltage V2*c* and the central voltage Vs1, select drive voltages corresponding to the selection signals S2*b*1, . . . , S2*bn* from the drive voltages V1, . . . , Vq, and output a sub-pixel data signal D2.

In the liquid crystal display device, the control circuit 4 outputs the clock signal ck, the control signal Ct, the image signal V4, the color selection signal CS and the central voltage Vs1. Another control circuit (not shown) outputs the color selection signal CS. The clock signal ck, the control signal Ct, the image signal V4 for each of RGB and the central voltage Vs1 are input to the signal electrode drive circuit 2. Then, gradation voltages corresponding to the gradation value of the image signal V4 for each of RGB are selected, and the sub-pixel data signal D2 is generated, which is sent to each of data signal lines X1, . . . , Xn of the liquid crystal panel 1.

In this case, the clock signal ck, the control signal Ct, and the image signal V4 are input to the serial/parallel conversion circuit 2*a*, from which the gradation values V2*a*1, . . . , V2*an* of the image signal V4 for each of RGB are output. The gradation values V2*a*1, . . . , V2*an* are input to the decoders 2*b*1, . . . , 2*bn* and decoded, from which selection signals S2*b*1, . . . , S2*bn* are output. The voltages VA, VB, and VC supplied to selected terminals A, B, and C are selected for every horizontal line period of the image of the liquid crystal panel 1 in the color selection circuit 2*c* based on the color selection signal CS, and the voltage V2*c* is output from the color selection circuit 2*c*. The drive voltages V1, . . . , Vq are input to the selection circuits 2*d*1, . . . , 2*dn*, and the drive voltage selected based on the selection signals S2*b*1, . . . , S2*bn* is output as the sub-pixel data signal D2 from the selection circuits 2*d*1, . . . , 2*dn*.

In addition, the clock signal ck is input to the scanning electrode drive circuit 3, the scanning signal V3 is generated synchronously with the clock signal ck, and the scanning signal V3 is sent to each of the scanning signal lines Y1, . . . , Ym of the liquid crystal panel 1. In the liquid crystal panel 1, the sub-pixel data signal D2 is supplied to the sub-pixel region selected by the scanning signal V3, and color image corresponding to the sub-pixel data signal D2 is displayed. Herein, voltages VA, VB, and VC are adjusted and input in accordance with the color of the color image on the liquid crystal panel 1, and thus the white balance of the color image is adjusted.

However, in the foregoing conventional general adjustment of the white balance, the use of the gradation value is limited in a particular color. Accordingly, there is a drawback in that combinations of the gradation of RGB, that is, kinds of display colors, are reduced. Moreover, in the method according to the foregoing literature, there is a problem in that the color filter of the liquid crystal panel 1 is limited to the horizontal-stripe type, and it can not deal with the color filters of the vertical stripe type, the mosaic type and the triangle type shown in FIG. 18.

SUMMARY OF THE INVENTION

In view of the above, it is an object of the present invention to provide a liquid crystal display device, in which a color correction voltage for each of RGB is generated, a liquid crystal drive voltage (that is, sub-pixel data signal) is independently generated for each of RGB, and a color image is displayed on a liquid crystal panel, and which can deal with various kinds of color filters.

To solve the above-described problems, according to a first aspect of the present invention, there is provided a liquid crystal display device including a liquid crystal panel for displaying a color image, wherein a color correction voltage generation circuit is provided for generating a color correction voltage for each of RGB based on a given input signal for color correction, and the color correction voltage of each of RGB is added to a gradation voltage of an image signal for each of RGB respectively, then the added voltages are supplied to the liquid crystal panel.

According to a second aspect of the present invention, there is provided a liquid crystal display device, including:

a liquid crystal panel having a plurality of data signal lines for receiving a sub-pixel data signal corresponding to a sub-pixel where a pixel is divided into three primary colors of RGB, a plurality of scanning signal lines for receiving a scanning signal, and a plurality of sub-pixel regions provided at points where each of the data signal lines and each of the scanning signal lines intersect, and the liquid crystal panel displaying a color image corresponding to the sub-pixel data signal by supplying the sub-pixel data signal to a sub-pixel region selected by the scanning signal among the plurality of sub-pixel regions;

a gradation voltage generation circuit for generating a plurality of gradation voltages to give gradation to the sub-pixel data signal;

a color correction voltage generation circuit for generating a color correction voltage for each of RGB based on a given input signal for color correction;

a display signal circuit for selecting a gradation voltage corresponding to a gradation value of an image signal for each of RGB from each gradation voltage, adding the color correction voltage for each of RGB respectively to the gradation voltage to generate the sub-pixel data signal, and sending the sub-pixel data signal to each data signal line of the liquid crystal panel;

a scanning signal circuit for sending the scanning signal to each scanning signal line of the liquid crystal panel synchronously with a clock signal; and a control circuit for outputting the clock signal and the image signal for each of RGB.

According to a third aspect of the present invention, there is provided a liquid crystal display device, including:

a liquid crystal panel having a plurality of data signal lines for receiving a sub-pixel data signal corresponding to a sub-pixel where a pixel is divided into three primary colors of RGB, a plurality of scanning signal lines for receiving a scanning signal, and a plurality of sub-pixel regions provided at points where each of the data signal lines and each of the scanning signal lines intersect, and the liquid crystal panel displaying a color image corresponding to the sub-pixel data signal by supplying the sub-pixel data signal to a sub-pixel region selected by the scanning signal among the plurality of sub-pixel regions;

a gradation voltage generation circuit for generating a plurality of gradation voltages to give gradation to the sub-pixel data signal, inverting a polarity of the gradation voltage in one frame period based on a polarity inversion signal, and outputting the gradation voltage with the inverted polarity;

a color correction voltage generation circuit for generating a color correction voltage for each of RGB based on a given input signal for color correction, inverting a polarity of the color correction voltage in one frame period based on the polarity inversion signal, and outputting the color correction voltage with the inverted polarity;

a display signal circuit for selecting a gradation voltage corresponding to a gradation value of an image signal for each of RGB from each gradation voltage, adding the color correction voltage for each of RGB respectively to the gradation voltage to generate the sub-pixel data signal, and sending the sub-pixel data signal to each data signal line of the liquid crystal panel;

a scanning signal circuit for sending the scanning signal to each scanning signal line of the liquid crystal panel synchronously with a clock signal; and a control circuit for outputting the clock signal and the image signal for each of RGB.

According to a fourth aspect of the present invention, there is provided a liquid crystal display device, including:

a liquid crystal panel having a plurality of data signal lines for receiving a sub-pixel data signal corresponding to a sub-pixel where a pixel is divided into three primary colors of RGB, a plurality of scanning signal lines for receiving a scanning signal, and a plurality of sub-pixel regions provided at points where each of the data signal lines and each of the scanning signal lines intersect, and the liquid crystal panel displaying a color image corresponding to the sub-pixel data signal by supplying the sub-pixel data signal to a sub-pixel region selected by the scanning signal among the plurality of sub-pixel regions;

a gradation voltage generation circuit for generating a plurality of gradation voltages to give gradation to the sub-pixel data signal, inverting a polarity of the gradation voltage in a specified number of horizontal line periods based on a polarity inversion signal, and outputting the gradation voltage with the inverted polarity;

a color correction voltage generation circuit for generating a color correction voltage for each of RGB based on a given input signal for color correction;

a polarity inversion circuit for inverting a polarity of the color correction voltage for each of RGB in a specified number of horizontal line periods based on the polarity inversion signal, and outputting the color correction voltage with the inverted polarity;

a display signal circuit for selecting a gradation voltage corresponding to a gradation value of an image signal for each of RGB from each gradation voltage, adding the color correction voltage for each of RGB respectively to the gradation voltage to generate the sub-pixel data signal, and sending the sub-pixel data signal to each data signal line of the liquid crystal panel;

a scanning signal circuit for sending the scanning signal to each scanning signal line of the liquid crystal panel synchronously with a clock signal; and a control circuit for outputting the clock signal, the image signal for each of RGB, and the polarity inversion signal.

According to a fifth aspect of the present invention, there is provided a liquid crystal display device, including:

a liquid crystal panel having a plurality of data signal lines for receiving a sub-pixel data signal corresponding to a sub-pixel where a pixel is divided into three primary colors of RGB, a plurality of scanning signal lines for receiving a scanning signal, and a plurality of sub-pixel regions provided at points where each of the data signal lines and each of the scanning signal lines intersect, and the liquid crystal panel displaying a color image corresponding to the sub-pixel data signal by supplying the sub-pixel data signal to a sub-pixel region selected by the scanning signal among the plurality of sub-pixel regions;

a gradation voltage generation circuit for generating a plurality of gradation voltages to give gradation to the sub-pixel data signal;

a color correction voltage generation circuit for generating a color correction voltage for each of RGB based on a given input signal for color correction;

a display signal circuit for selecting a gradation voltage corresponding to a gradation value of an image signal for each of RGB from each gradation voltage, inverting the color correction voltage for each of RGB at each sub-pixel based on a polarity inversion signal and adding the color correction voltage with the inverted polarity to the gradation voltage to generate the sub-pixel data signal, and sending the sub-pixel data signal to each data signal line of the liquid crystal panel;

a scanning signal circuit for sending the scanning signal to each scanning signal line of the liquid crystal panel synchronously with a clock signal; and a control circuit for outputting the clock signal, the image signal for each of RGB, and the polarity inversion signal.

According to a sixth aspect of the present invention, there is provided a liquid crystal display device, including:

a liquid crystal panel having a plurality of data signal lines for receiving a sub-pixel data signal corresponding to a sub-pixel where a pixel is divided into three primary colors of RGB, a plurality of scanning signal lines for receiving a scanning signal, and a plurality of sub-pixel regions provided at points where each of the data signal lines and each of the scanning signal lines intersect, and the liquid crystal panel displaying a color image corresponding to the sub-pixel data signal by supplying the sub-pixel data signal to a sub-pixel region selected by the scanning signal among the plurality of sub-pixel regions;

a gradation voltage generation circuit for generating a plurality of gradation voltages to give gradation to the sub-pixel data signal;

a color correction voltage generation circuit for generating a color correction voltage for each of RGB based on a given input signal for color correction;

a multiplexer for selecting and outputting the color correction voltage for each of RGB in accordance with an arrangement of RGB color filters in a horizontal direction of the sub-pixels on the liquid crystal panel, based on a control signal;

a display signal circuit for selecting a gradation voltage corresponding to a gradation value of an image signal for each of RGB from each gradation voltage, adding the color correction voltage for each of RGB output from the multiplexer respectively to the gradation voltage to generate the sub-pixel data signal, and sending the sub-pixel data signal to each data signal line of the liquid crystal panel;

a scanning signal circuit for sending the scanning signal to each scanning signal line of the liquid crystal panel synchronously with a clock signal; and a control circuit for outputting the clock signal, the image signal for each of RGB, and the control signal.

With the above configurations, the color correction voltage for each of RGB is added to the gradation voltage for each of RGB. Accordingly, the sub-pixel data signal can be controlled and adjusted independently for each of RGB. Therefore, the white balance can be adjusted without reducing the number of the gradation values. Furthermore, the control circuit for outputting the control signal corresponding to the arrangement of RGB of the sub-pixel and the MUX for selecting and outputting the color correction voltage for each of RGB in accordance with the arrangement of RGB of the sub-pixel of the liquid crystal panel are provided, based on the control signal. Accordingly, the present invention can cope with various color filters.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

In driving methods of a liquid crystal display device, there are basic driving methods such as a frame inversion drive, a line inversion drive, and a dot inversion drive. Voltages higher (positive polarity) and lower (negative polarity) than a common voltage (0V) are supplied to the liquid crystal panel as drive voltages, and the liquid crystal panel is driven by an alternating voltage. The drive voltage is generated by allowing a few kinds of gradation voltages generated in the gradation voltage generation circuit to be divided into fragments by a resistor in the signal electrode drive circuit. For example, ten kinds of gradation voltages are generated in the gradation voltage generation circuit, and the gradation voltages are divided by the resistor in the signal electrode drive circuit to generate 128 kinds of gradation voltages. This time, in the case of the dot inversion drive, since the gradation voltages are divided into 64 kinds of gradation voltages above the common voltage and 64 kinds of gradation voltages below the common voltage, the signal electrode drive circuit generates the drive voltage with 64 gradations. In the frame inversion drive and the line inversion drive, either the gradation voltage of positive polarity or the gradation voltage of negative polarity is input to the signal electrode drive circuit. In the dot inversion drive, the gradation voltages of the both polarities are input to the signal electrode drive circuit.

Best modes for carrying out the present invention will be described in further detail using various embodiments with reference to the accompanying drawings.

First Embodiment

Figure 1:
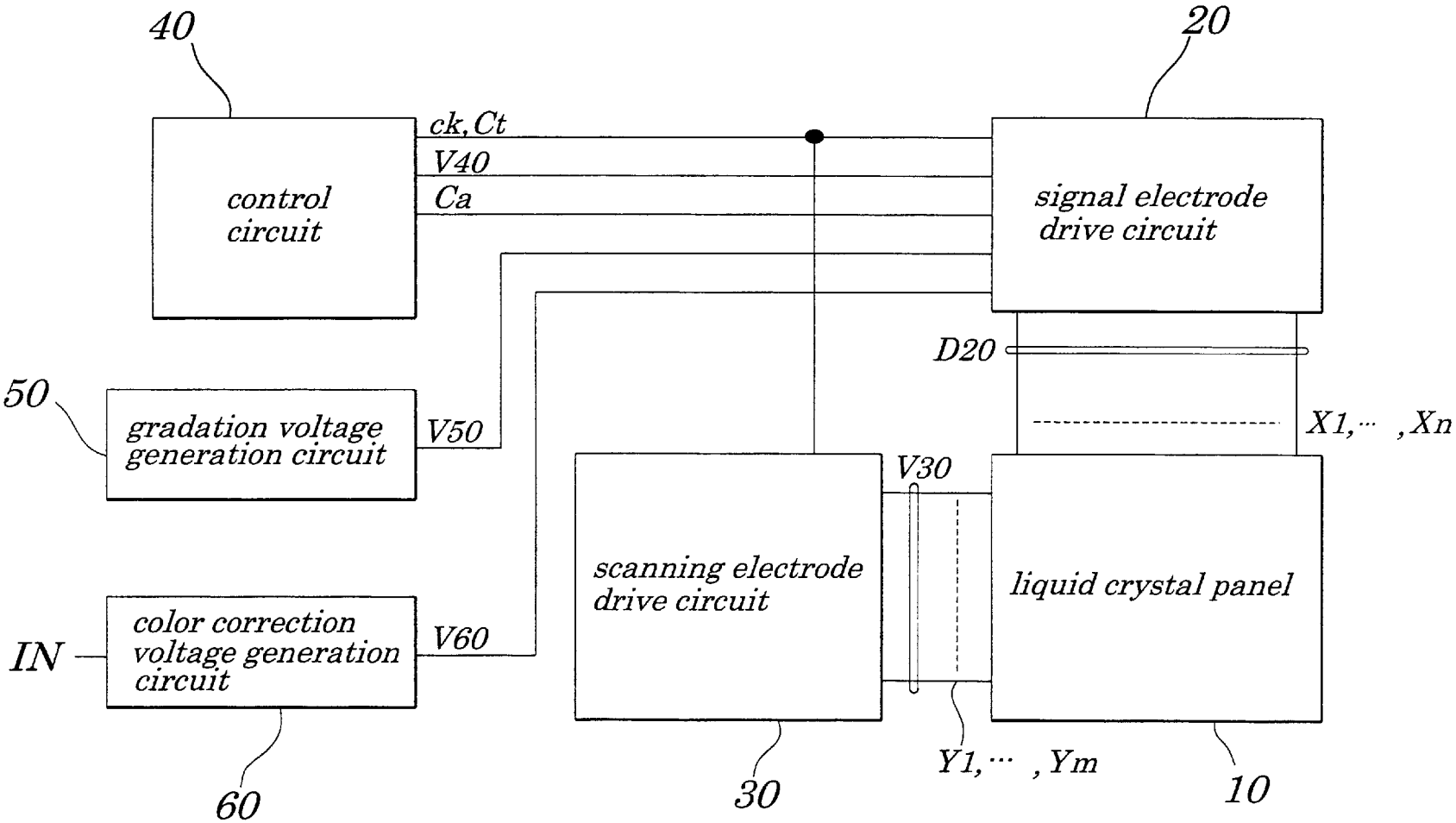
FIG. 1 is a block diagram showing an electrical configuration of a liquid crystal display device according to a first embodiment of the present invention.

FIG. 1 is a block diagram showing an electrical configuration of a liquid crystal display device according to a first embodiment of the present invention.

The liquid crystal display device of this embodiment, as shown in FIG. 1, includes: a liquid crystal panel 10; a display signal circuit (for example, a signal electrode drive circuit 20); a scanning signal circuit (for example, a scanning electrode drive circuit 30); a control circuit 40; a gradation voltage generation circuit 50; and a color correction voltage generation circuit 60. The liquid crystal panel 10 has color filters where pixels are divided into sub-pixels of three primary colors of RGB. The liquid crystal panel 10 also includes: a plurality of data signal lines X1, . . . , Xn for receiving a sub-pixel data signal D20 corresponding to the sub-pixels of RGB; a plurality of scanning signal lines Y1, . . . , Ym for receiving a scanning signal V30; and a plurality of sub-pixel regions provided at points where each of the data signal lines X1, . . . , Xn and each of the scanning signal lines Y1, . . . , Ym intersect. The sub-pixel data signal D20 is supplied to sub-pixel regions selected from the plurality of sub-pixel regions by the scanning signal V30, and thus a color image corresponding to the sub-pixel data signal D20 is displayed.

The signal electrode drive circuit 20 receives a clock signal ck, a control signal Ct, an image signal V40 for each of RGB, an adding circuit control signal Ca, a plurality of gradation voltages V50, and a color correction voltage V60, selects a gradation voltage corresponding to a gradation value of the image signal V40 for each of RGB from each gradation voltage V50, adds the color correction voltage V60 for each of RGB to the gradation voltage to generate the sub-pixel data signal D20, and sends the sub-pixel data signal D20 to each of the data signal lines X1, . . . , Xn of the liquid crystal panel 10. The scanning electrode drive circuit 30 sends the scanning signal V30 to each of the scanning signal lines Y1, . . . , Ym of the liquid crystal panel 10 synchronously with the clock signal ck.

The control circuit 40 outputs the clock signal ck, the image signal V40 for each of RGB, and the adding circuit control signal Ca. The gradation voltage generation circuit 50 generates a plurality of the gradation voltages V50 (for example, V1, . . . , VQ) for giving gradation to the sub-pixel data signal D20. The color correction voltage generation circuit 60 generates the color correction voltage V60 for each of RGB based on a given input signal "IN" for color correction.

Figure 2:
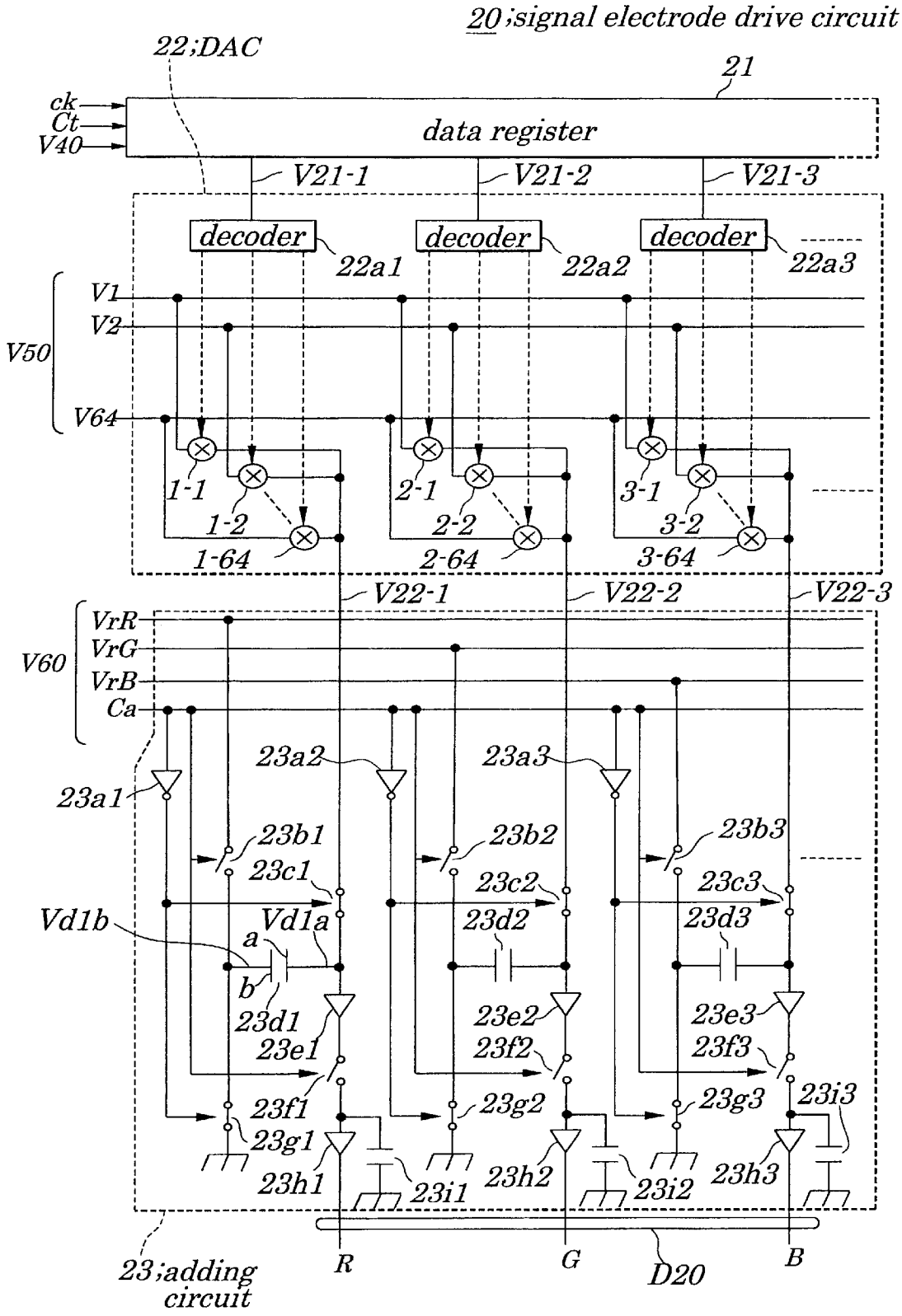
FIG. 2 is a circuit diagram showing an electrical configuration of a signal electrode drive circuit 20 shown in FIG. 1.

FIG. 2 is a circuit diagram showing an electrical configuration of the signal electrode drive circuit 20 in FIG. 1.

The signal electrode drive circuit 20 includes: a data register 21; a digital/analog converter (hereinafter, referred to as DAC 22); and an adding circuit 23. The data register 21 receives the clock signal ck, the control signal Ct, and the image signal V40, and outputs gradation values V21-1, V21-2, . . . , V21-*n* of the image signal V40 for each of RGB. The DAC 22 includes: decoders 22*a*1, 22*a*2, . . . , 22*an*; and selection switches 1-1, 1-2, . . . , 1-64, 2-1, 2-2, . . . , 2-64, . . . , n-1, n-2, . . . , n-64, divides the gradation voltages V50 (V1, . . . , VQ) by a voltage dividing resistor circuit (not shown) to generate the gradation voltages V1, . . . , V64, selects the gradation voltages V22-1, V22-2, . . . , V22-*n* corresponding to the gradation values V21-1, V21-2, . . . , V21-*n* of the image signal V40 for each of RGB from the gradation voltages V1, . . . , V64, and outputs the gradation voltages.

The adding circuit 23 includes: inverters 23*a*1, 23*a*2, . . . , 23*an*; switches 23*b*1, 23*b*2, . . . , 23*bn*; switches 23*c*1, 23*c*2, . . . , 23*cn*; capacitors 23*d*1, 23*d*2, . . . , 23*dn*; buffers 23*e*1, 23*e*2, . . . , 23*en*; switches 23*f*1, 23*f*2, . . . , 23*fn*; switches 23*g*1, 23*g*2, . . . , 23*gn*; buffers 23*h*1, 23*h*2, . . . , 23*hn*; and capacitors 23*i*1, 23*i*2, . . . , 23*in*. The adding circuit 23 adds the color correction voltage V60 (for example, VrR, VrG, VrB) to the gradation voltages V22-1, V22-2, . . . , V22-*n* based on the adding circuit control signal Ca, and outputs the sub-pixel data signal D20.

Next, an operation of the liquid crystal display device of this embodiment will be described.

The control circuit 40 outputs the clock signal ck, the image signal V40 for each of RGB and the adding circuit control signal Ca. The gradation voltage generation circuit 50 outputs a plurality of the gradation voltages V50 (V1, . . . , VQ). The color correction voltage generation circuit 60 generates the color correction voltage V60 for each of RGB based on, for example, the input signal "IN" for color correction given by a user or a like.

The signal electrode drive circuit 20 receives the clock signal ck, the control signal Ct, the image signal V40, the adding circuit control signal Ca, the gradation voltage V50, and the color correction voltage V60, selects the gradation voltage V50 corresponding to the gradation value of the image signal V40 for each of RGB from the gradation voltage V50, adds the color correction voltage V60 for each of RGB to the gradation voltage V50, and generates the sub-pixel data signal D20. The sub-pixel data signal D20 is sent to each of the data signal lines X1, . . . , Xn of the liquid crystal panel 10.

In this case, data register 21 receives the clock signal ck, the control signal Ct, and the image signal V40, and outputs the gradation values V21-1, V21-2, . . . , V21-*n* of the image signal V40 for each of RGB. The DAC 22 receives the gradation values V21-1, V21-2, . . . , V21-*n*, selects the gradation voltages V22-1, V22-2, . . . , V22-*n* corresponding to the gradation values V21-1, V21-2, . . . , V21-*n* from the gradation voltages V1, . . . , V64, and outputs the gradation voltages. The adding circuit 23 receives the gradation voltages V22-1, V22-2, . . . , V22-*n*, adds the color correction voltage V60 (VrR, VrG, VrB) based on the adding circuit control signal Ca, and outputs the sub-pixel data signal D20.

In the adding circuit 23, in accordance with the adding circuit control signal Ca, the switch 23*b*1 and the switch 23*f*1 become in an OFF state when the switch 23*c*1 and the switch 23*g*1 are in an ON state, and the switch 23*b*1 and the switch 23*f*1 become in an ON state when the switch 23*c*1 and the switch 23*g*1 are in an OFF state. The adding circuit control signal Ca changes its theory level from a low level (hereinafter, referred to as L) to a high level (hereinafter, referred to as H) in one horizontal period. When the switch 23*c*1 and the switch 23*g*1 are in an ON state and the switch 23*b*1 and the switch 23*f*1 are in an OFF state, a voltage Vd1*a* of an electrode "a" of the capacitor 23*d*1 connected to an input side of the buffer 23*e*1 becomes an equal value as the gradation voltage V22-1. Next, when the switch 23*c*1 and the switch 23*g*1 are in an OFF state and the switch 23*b*1 and the switch 23*f*1 are in an ON state, a voltage Vd1*b* of an electrode "b" of the capacitor 23*d*1 becomes the color correction voltage VrR. Accordingly, the voltage Vd1*a* of the electrode "a" becomes as follows:

Vd1*a*=gradation voltage (V22-1)+color correction voltage (VrR). The voltage Vd1*a* is output as the sub-pixel data signal D20 of R component via the buffer 23*h*1. The sub-pixel data signals D20 of G component and B component are output in the same manner.

The scanning electrode drive circuit 30 receives the clock signal ck, generates the scanning signal V30 synchronously with the clock signal ck, and sends the scanning signal V30 to each of the scanning signal lines Y1, . . . , Ym of the liquid crystal panel 10. In the liquid crystal panel 10, the sub-pixel data signal D20 is supplied to a sub-pixel region selected by the scanning signal V30, and a color image corresponding to the sub-pixel data signal D20 is displayed.

As described above, since the first embodiment is designed such that the color correction voltage V60 for each of RGB (VrR, VrG, VrB) is added to the gradation voltages V22-1, V22-2, . . . , V22-*n*, the sub-pixel data signal D20 is controlled and adjusted independently for each of RGB. Therefore, adjustment of the white balance is enabled without reducing the number of the gradation values of the color image.

Second Embodiment

Figure 3:
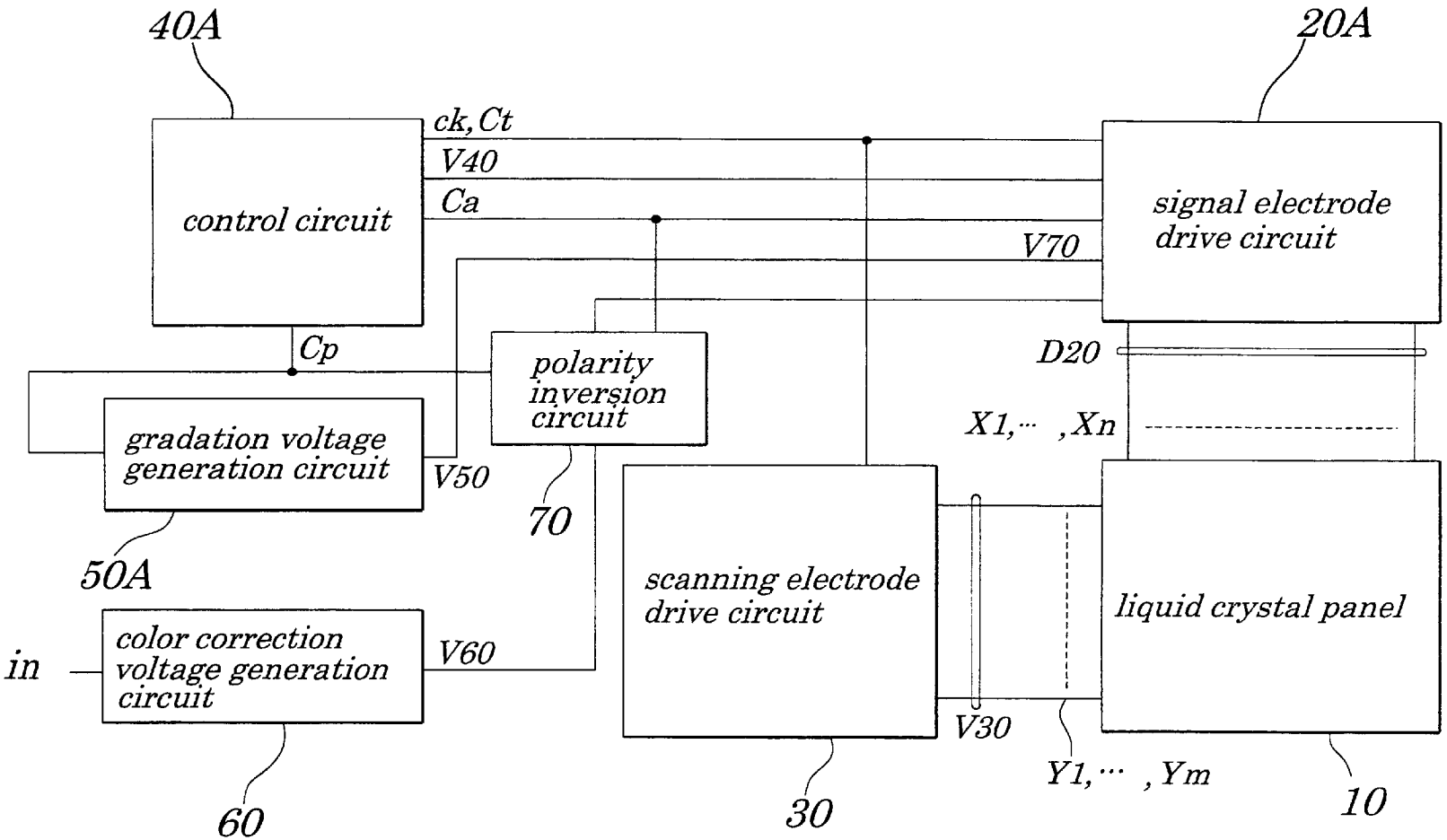
FIG. 3 is a block diagram showing an electrical configuration of a liquid crystal display device according to a second embodiment of the present invention.

FIG. 3 is a block diagram showing an electrical configuration of a liquid crystal display device of a line inversion driving method according to the second embodiment of the present invention. Common reference numerals are given to elements common to elements of FIG. 1 showing the first embodiment.

In the liquid crystal display device, a signal electrode drive circuit 20A, a control circuit 40A and a gradation voltage generation circuit 50A having a different configuration are provided instead of a signal electrode drive circuit 20, a control circuit 40 and a gradation voltage generation circuit 50 shown in FIG. 1, and further, a polarity inversion circuit 70 is also provided. The signal electrode drive circuit 20A is designed to receive a color correction voltage V70 instead of a color correction voltage V60 (FIG. 1) input to the signal electrode drive circuit 20 (FIG. 1). The control circuit 40A has a function to output a polarity inversion signal Cp in addition to the function of the control circuit 40 (FIG. 1). The gradation voltage generation circuit 50A inverts and outputs a polarity of a gradation voltage V50, for example, in one horizontal line period, based on the polarity inversion signal Cp. The polarity inversion circuit 70 inverts a polarity of a color correction voltage V60 for each of RGB in one horizontal line period based on the polarity inversion signal Cp, and outputs the color correction voltage V70. Other parts of the configuration are approximately the same as that of FIG. 1; and therefore their description has been omitted.

Figure 4:
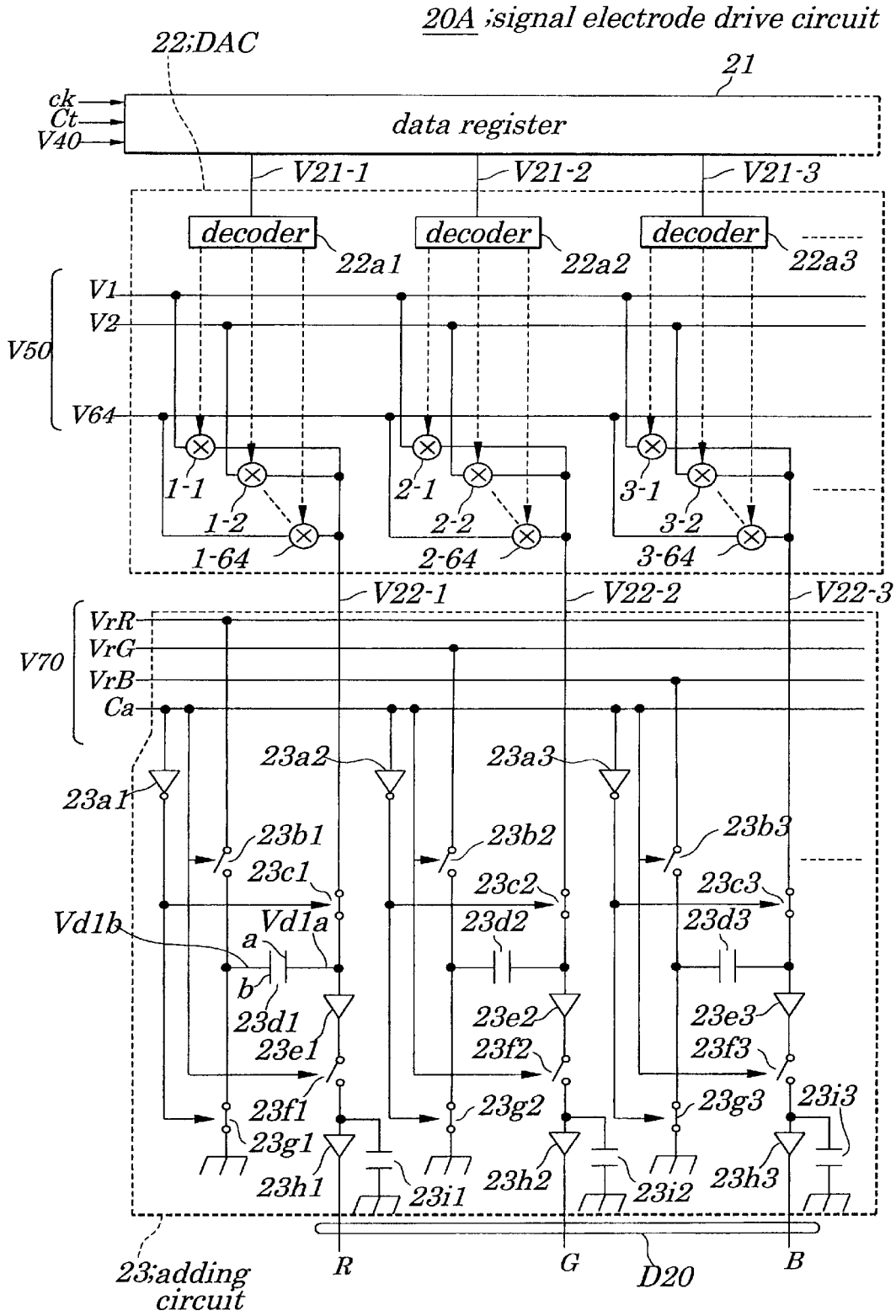
FIG. 4 is a circuit diagram showing an electrical configuration of a signal electrode drive circuit 20A in FIG. 3.

FIG. 4 is a circuit diagram showing an electrical configuration of the signal electrode drive circuit 20A in FIG. 3.

As shown in FIG. 4, the signal electrode drive circuit 20A has a same electrical configuration as that of a signal electrode drive circuit 20 shown in FIG. 2. However, the signal electrode drive circuit 20A is different from the signal electrode drive circuit 20 in that the color correction voltage V70 is input to an adding circuit 23 instead of the color correction voltage V60.

Figure 5:
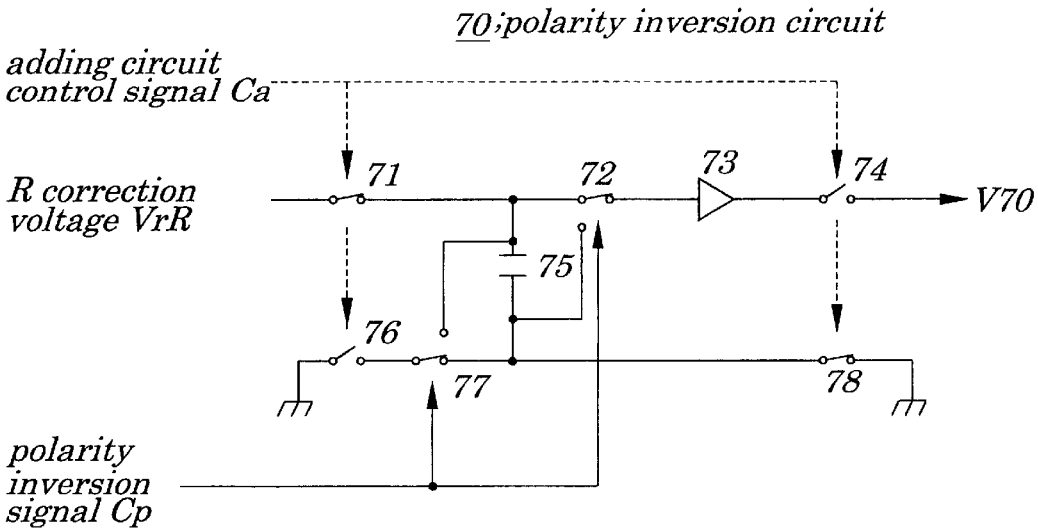
FIG. 5 is a circuit diagram showing an electrical configuration of a circuit for inverting polarity of a color correction voltage V60 of an R component in a polarity inversion circuit 70 in FIG. 3.

FIG. 5 is a circuit diagram showing an electrical configuration of a circuit for inverting polarity of the color correction voltage V60 of an R component (of RGB) in the polarity inversion circuit 70 of FIG. 3.

The polarity inversion circuit 70 includes: a switch 71, a switch 72, a buffer 73, a switch 74, a capacitor 75, a switch 76, switch 77 and a switch 78. Circuits for inverting polarity of the color correction voltage V60 of a G component (of RGB) and a B component (of RGB) have the same configuration.

Figure 6:
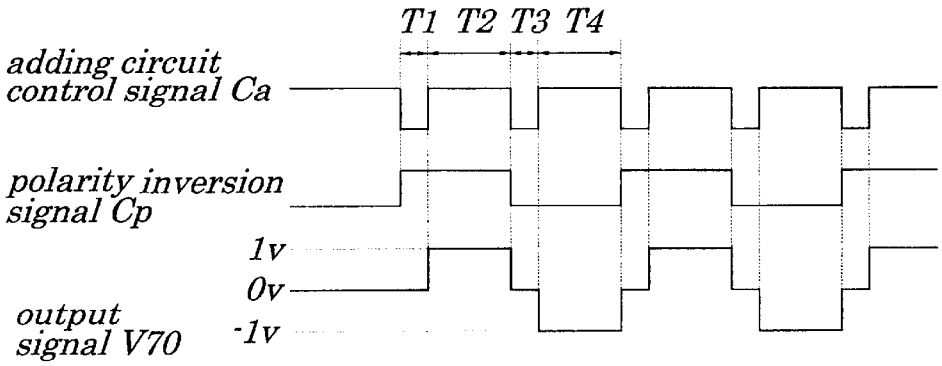
FIG. 6 is a timing chart showing an operation of the polarity inversion circuit 70.

FIG. 6 is a timing chart showing an operation of the polarity inversion circuit 70. FIG. 7, FIG. 8, FIG. 9 and FIG. 10 are circuit diagrams respectively showing a state of the polarity inversion circuit 70 based on FIG. 6.

In the operation of the liquid crystal display device of the embodiment, the following point is different from the above-described first embodiment. Specifically, polarity of the color correction voltage V60 for each of RGB is inverted by the polarity inversion circuit 70 in one horizontal line period based on an adding circuit control signal Ca and a polarity inversion signal Cp, and added to gradation voltages V22-1, V22-2, . . . , V22-*n* respectively, and thus a sub-pixel data signal D20 (FIG. 4) is generated.

Figure 7:
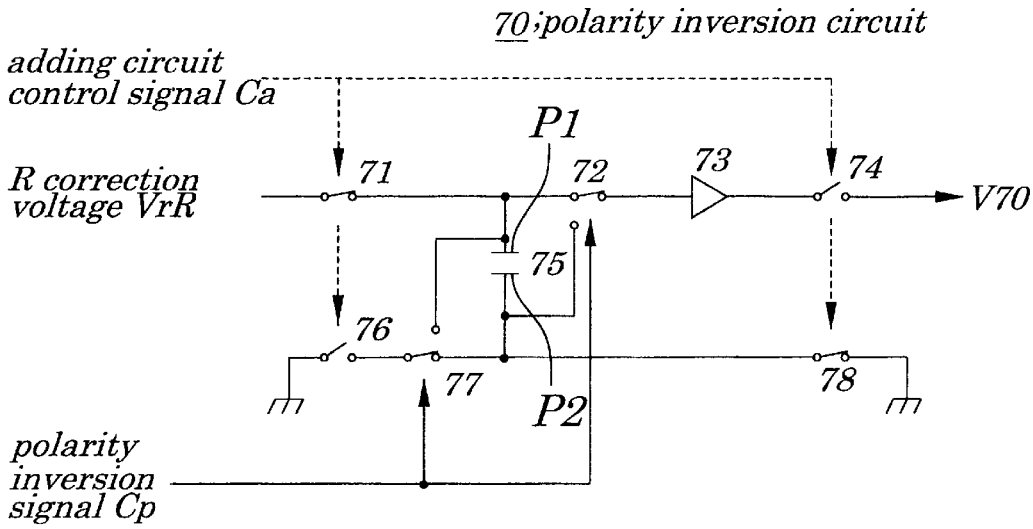
FIG. 7 is a circuit diagram showing a state of the polarity inversion circuit 70 based on FIG. 6.
Figure 8:
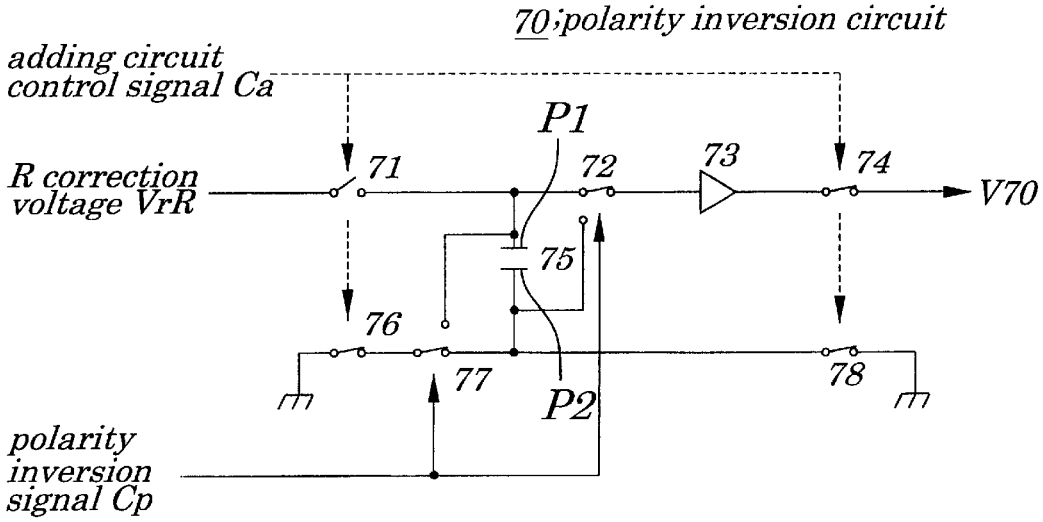
FIG. 8 is another circuit diagram showing a state of the polarity inversion circuit 70 based on FIG. 6.
Figure 9:
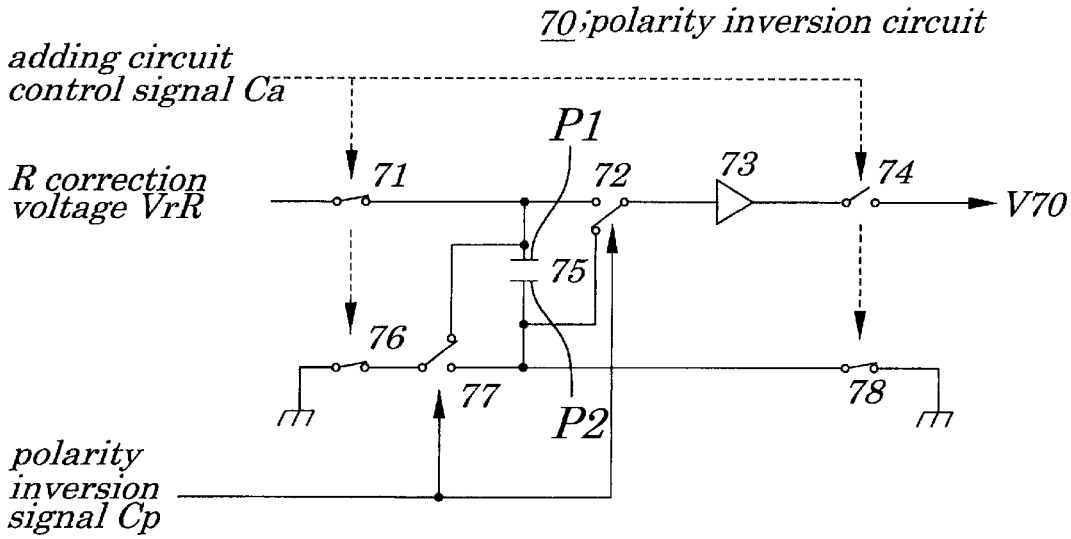
FIG. 9 is another circuit diagram showing a state of the polarity inversion circuit 70 based on FIG. 6.
Figure 10:
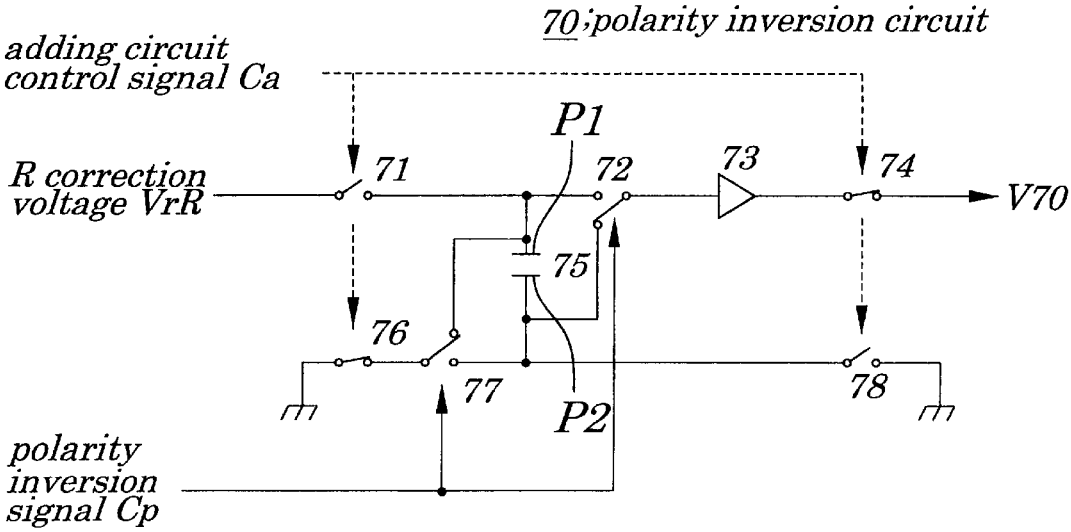
FIG. 10 is still another circuit diagram showing a state of the polarity inversion circuit 70 based on FIG. 6.

In this case, at a time T1 of FIG. 6, the adding circuit control signal Ca is "L" (Low) and the polarity inversion signal Cp is "H" (High), and thus the polarity inversion circuit 70 is in a state shown in FIG. 7. Here, a potential of an electrode P1 of the capacitor 75 is R correction voltage VrR (for example, 1V). At a time T2, the adding circuit control signal Ca is "H" and the polarity inversion signal Cp is "H", and thus the polarity inversion circuit 70 is in a state shown in FIG. 8. Here, a potential of the electrode P1 (that is, 1V) of the capacitor 75 is output as the color correction voltage V70 (that is, 1V) via the switch 72, the buffer 73, and the switch 74. At a time T3, the adding circuit control signal Ca is "L" and the polarity inversion signal Cp is "L", and thus the polarity inversion circuit 70 is in a state shown in FIG. 9. Here, the color correction voltage V70 is 0V. At a time T4, the adding circuit control signal Ca is "H" and the polarity inversion signal Cp is "L", and thus the polarity inversion circuit 70 is in a state shown in FIG. 10. Here, the potential of the electrode P2 of the capacitor 75 (that is, −1V) is output as the color correction voltage V70 (that is, −1V) via the switch 72, the buffer 73 and the switch 74.

As described above, since the second embodiment is designed such that the color correction voltage V60 for each of RGB (VrR, VrG, VrB) is inverted in one horizontal line period and added to the gradation voltages V22-1, V22-2, . . . , V22-*n* as the color correction voltage V70, the sub-pixel data signal D20 is controlled and adjusted independently for each of RGB. Therefore, similarly to the first embodiment, adjustment of white balance is enabled without reducing the number of a gradation value of a color image.

Third Embodiment

Figure 11:
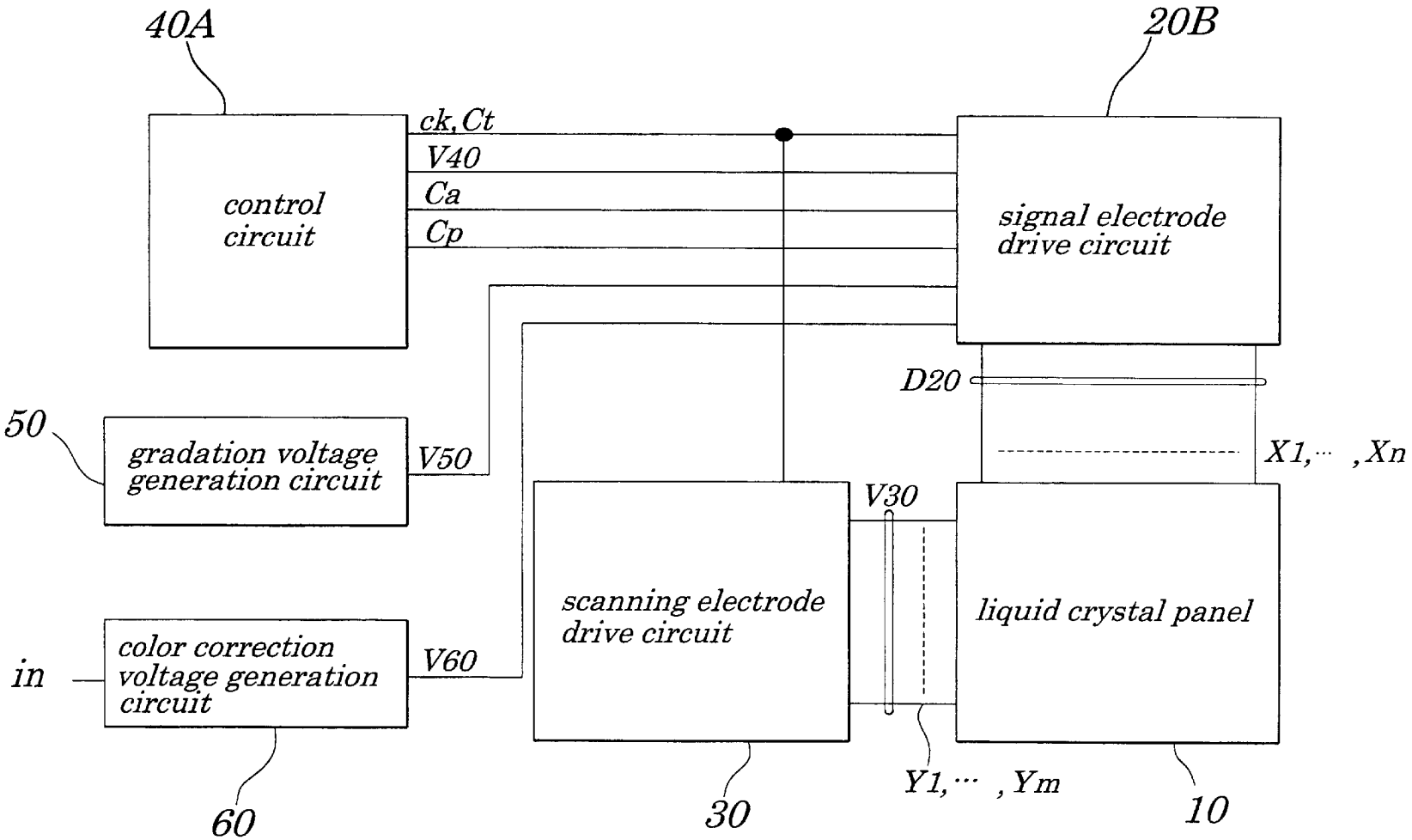
FIG. 11 is a block diagram showing an electrical configuration of a liquid crystal display device according to a third embodiment of the present invention.

FIG. 11 is a block diagram showing an electrical configuration of a liquid crystal display device of a dot inversion driving method according to the third embodiment of the present invention. Common reference numerals are given to elements common to elements of FIG. 1 showing the first embodiment and elements of FIG. 2 showing the second embodiment and therefore details of them are omitted.

In the liquid crystal display device, a signal electrode drive circuit 20B of a different configuration is provided instead of a signal electrode drive circuit 20 shown in FIG. 1. Moreover, the control circuit 40A identical to that of FIG. 3 is provided instead of a control circuit 40 shown in FIG. 1. The signal electrode drive circuit 20B selects a gradation voltage corresponding to a gradation value of an image signal V40 for each of RGB from a gradation voltage V50, inverts a polarity of a color correction voltage V60 for each of RGB based on an adding circuit control signal Ca and a polarity inversion signal Cp. Then, the color correction voltage V60 for each of RGB with inverted polarity is respectively added to the gradation voltage to generate a sub-pixel data signal D20, and the sub-pixel data signal D20 is sent to each of data signal lines X1, . . . , Xn of the liquid crystal panel. Other parts of the configuration are the same as that of FIG. 1 and their description has been omitted.

Figure 12:
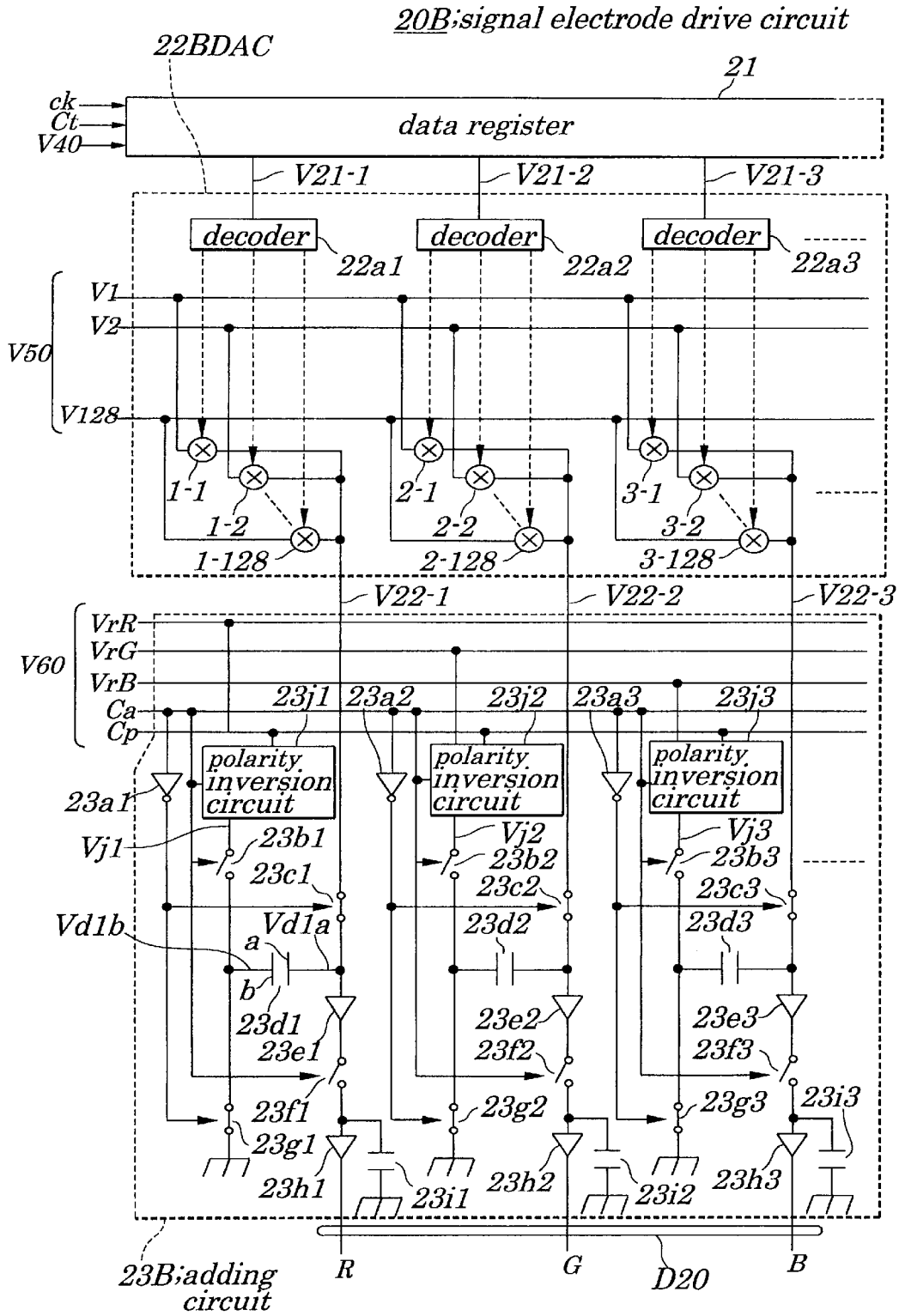
FIG. 12 is a circuit diagram showing an electrical configuration of a signal electrode drive circuit 2 GB in FIG. 11.

FIG. 12 is a circuit diagram showing an electrical configuration of the signal electrode drive circuit 20B in FIG. 11. Common reference numerals are given to elements common to elements of FIG. 2 showing the first embodiment.

In signal electrode drive circuit 20B, DAC 22B, and adding circuit 23B having a different configuration are provided instead of a DAC 22 and an adding circuit 23 in FIG. 2. The DAC 22B includes: decoders 22*a*1, 22*a*2, . . . , 22*an*; and selection switches 1-1, 1-2, . . . , 1-128, 2-1, 2-2, . . . , 2-128, . . . , n-1, n-2, . . . , n-128, divides gradation voltages V50 (V1, . . . , VQ) by a voltage dividing resistor circuit (not shown) to generate gradation voltages V1, . . . , V128, selects gradation voltages V22-1, V22-2, . . . , V22-*n* corresponding to the gradation values V21-1, V21-2, . . . , V21-*n* of an image signal V40 for each of RGB from the gradation voltages V1, . . . , V128, and outputs selected gradation voltages. As the gradation voltages V50 (V1, . . . , VQ), a voltage of positive polarity and a voltage of negative polarity are supplied, where 0V is a common voltage.

In the adding circuit 23B, polarity inversion circuits 23*j*1, 23*j*2, . . . , 23*jn* are added to the adding circuit 23. Among them, polarity inversion circuits 23*j*[2*k*+1] (where k=0, 1, 2, . . . ) in odd numbers have a configuration same as FIG. 5 showing the second embodiment, invert a polarity of a color correction voltage V60 for each of RGB at each sub-pixel based on an adding circuit control signal Ca and a polarity inversion signal Cp, and output an output signal V*j*[2*k*+1] (where k=0, 1, 2, . . . ). Polarity inversion circuits 23*j*[2*k*] (where k=1, 2, . . . ) in even numbers are constituted such that an ON/OFF operation of a switch 72 and a switch 77 in FIG. 5 is made to be opposite to that of the polarity inversion circuits 23*j*[2*k*+1]. Other parts of the configuration are approximately same as that of FIG. 2.

Figure 13:
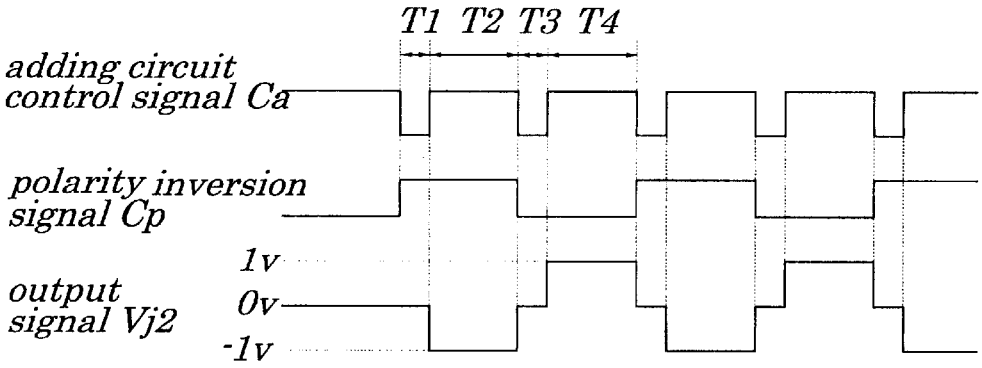
FIG. 13 is a timing chart showing an operation of a polarity inversion circuit 23*j* (2*k*) in FIG. 12.

FIG. 13 is a timing chart showing an operation of the polarity inversion circuit 23*j*[2*k*] in FIG. 12.

In an operation of the liquid crystal display device of the embodiment, the following point is different from the above-described second embodiment. That is, as shown in FIG. 13, operation of the polarity inversion circuit 23*j*[2*k*] at a time T2 and a time T4 is opposite to operation of polarity inversion circuits 23*j*[2*k*+1] shown in FIG. 5. Thus, output voltage Vj2 in antiphase to an output voltage V70 of a polarity inversion circuit 70 is output. Therefore, polarity of the color correction voltage V60 for each of RGB is inverted for each sub-pixel based on the adding circuit control signal Ca and the polarity inversion signal Cp, added to the gradation voltages V22-1, V22-2, . . . , V22-*n* respectively, and the sub-pixel data signal D20 is generated.

As described above, since the third embodiment is designed such that the color correction voltage V60 for each of RGB (VrR, VrG, VrB) is inverted at each sub-pixel and added to the gradation voltages V22-1, V22-2, . . . , V22-*n*, the sub-pixel data signal D20 is controlled and adjusted independently for each of RGB. Therefore, similarly to the first embodiment, adjustment of white balance is enabled without reducing the number of gradation values of a color image.

Fourth Embodiment

Figures 17, 18:
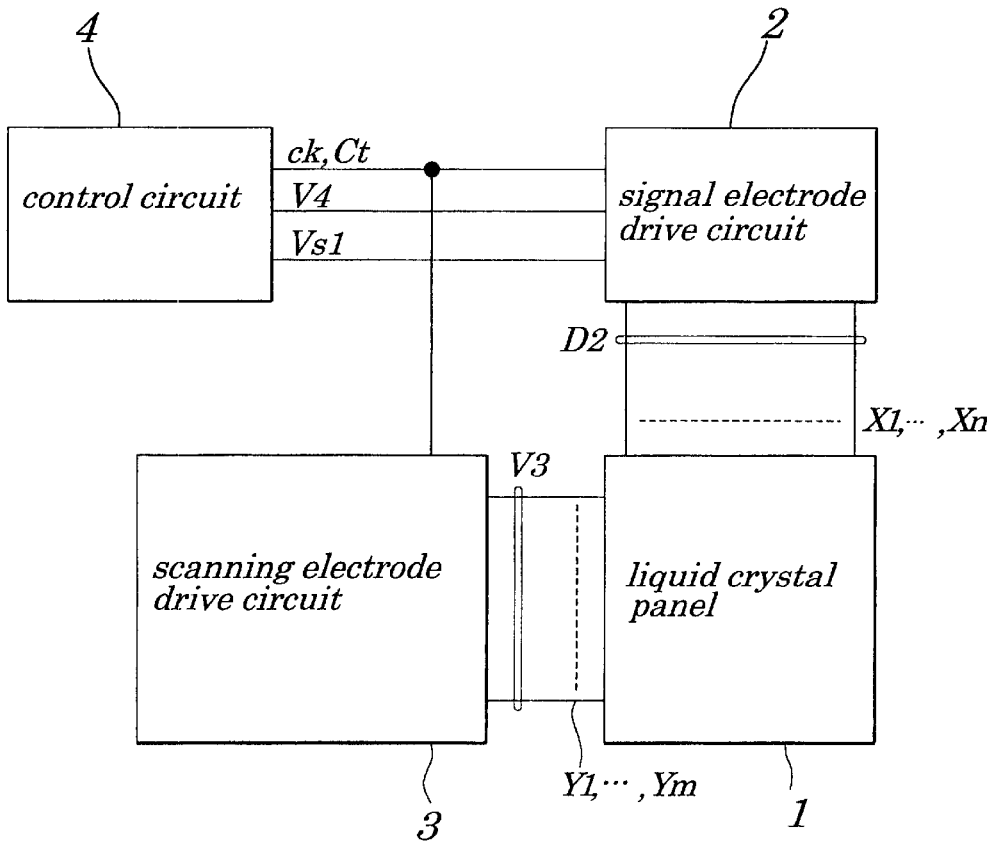
FIG.18(PRIOR ART)
FIG. 17 is a graph explaining an operation of the MUX 80.
FIG. 18 is a block diagram showing an electrical configuration of a conventional liquid crystal device.
Figures 19A, 19B, 19C:
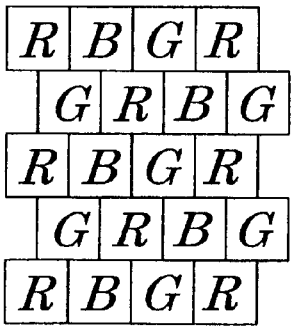
FIG. 19A(PRIOR ART)
FIG. 19B(PRIOR ART)
FIG. 19C(PRIOR ART)
FIGS. 19(*a*), 19(*b*) and 19(*c*) are exemplary diagrams showing examples of color filters.
Figure 20:
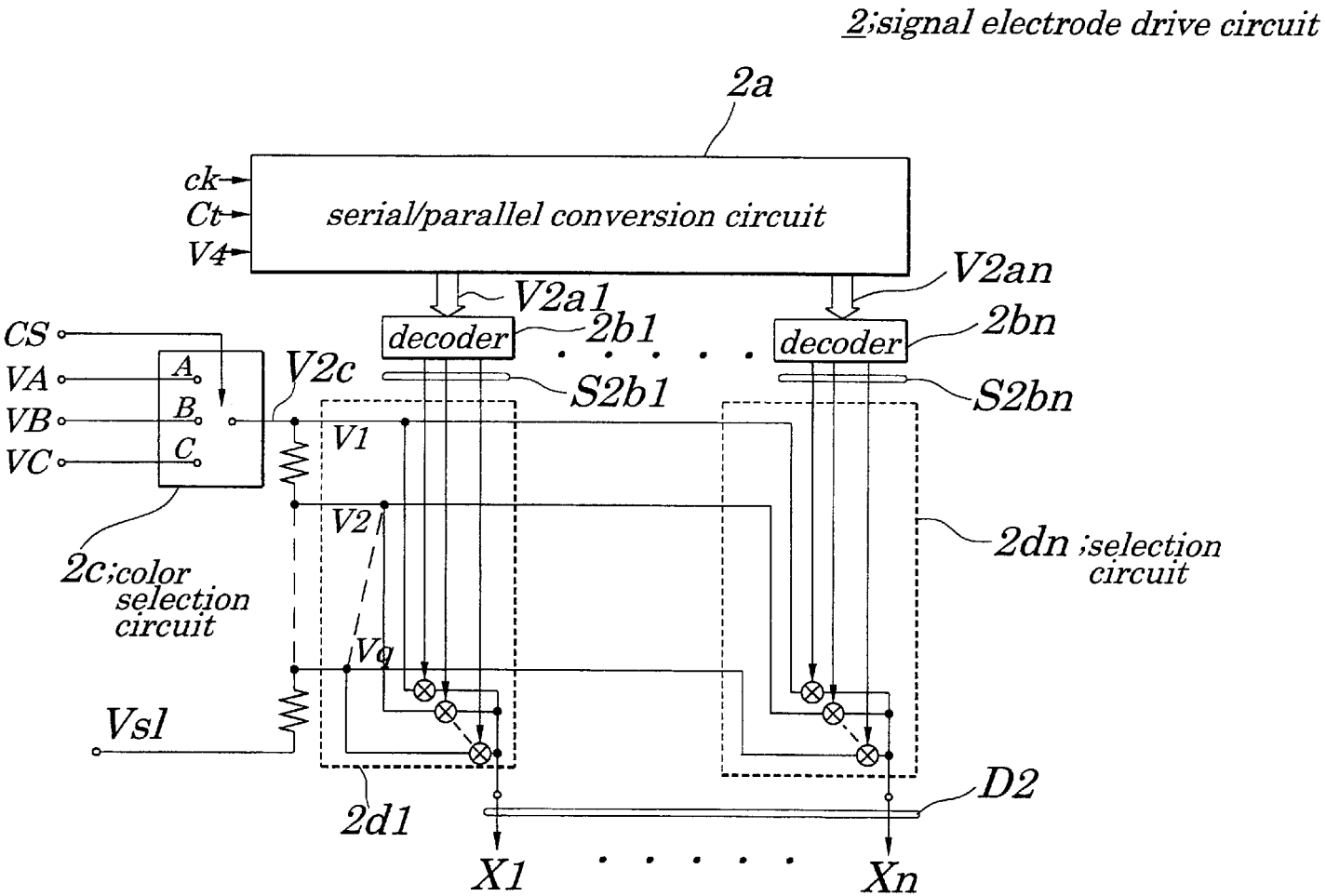
FIG.20(PRIOR ART)
FIG. 20 is a circuit diagram showing an electrical configuration of a signal electrode drive circuit 2 described in a literature.

The foregoing first, second and third embodiments are described as the liquid crystal display device using the color filter of the vertical stripe type shown in FIG. 18(*a*). This embodiment is the one that deals with the color filters of the mosaic type, the horizontal stripe type and the like in which the arrangement of the color filters of RGB is repeated at every horizontal line.

Figure 14:
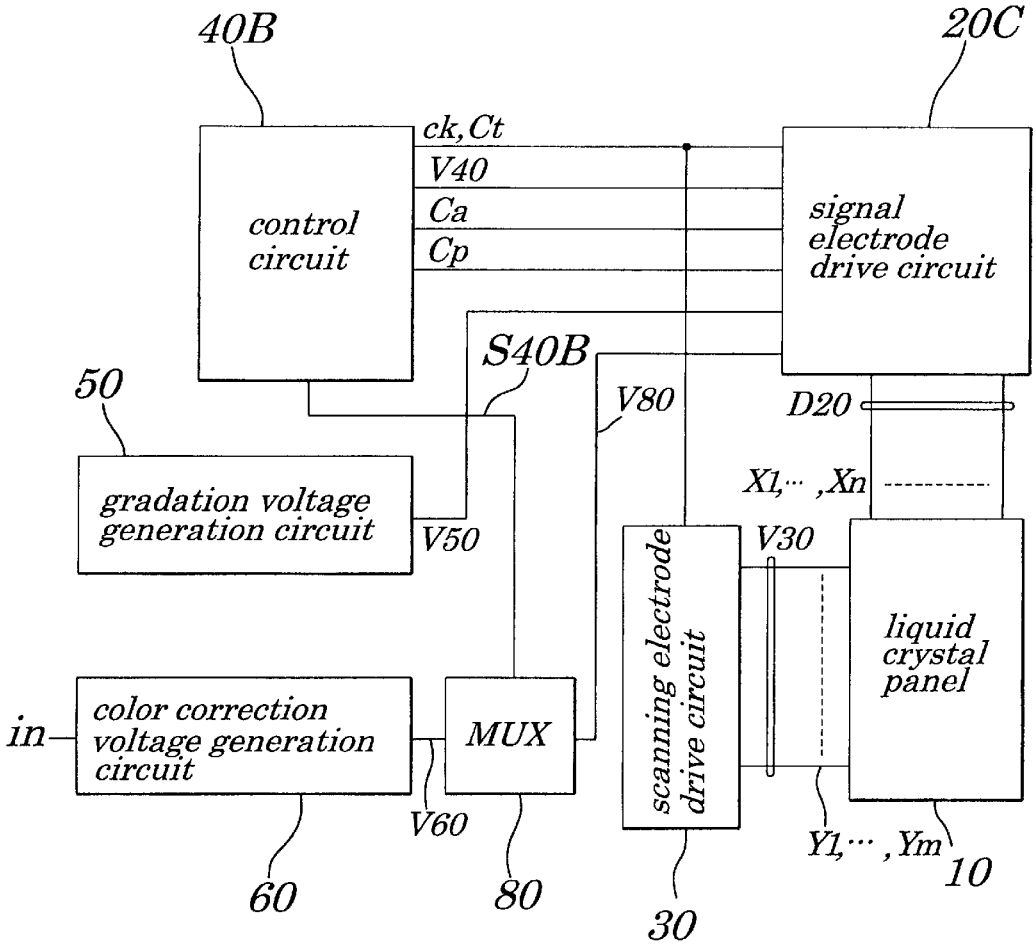
FIG. 14 is a block diagram showing an electrical configuration of a liquid crystal display device according to a fourth embodiment of the present invention.

FIG. 14 is a block diagram showing an electrical configuration of the liquid crystal display device, which is a fourth embodiment of the present invention. Common reference numerals are given to elements common to elements of FIG. 11 showing the third embodiment.

Figure 15:
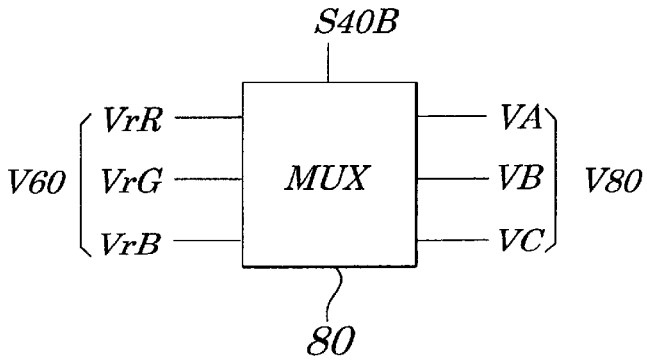
FIG. 15 is a configuration diagram of a MUX 80 in FIG. 14.

In the liquid crystal display device of the fourth embodiment, a control circuit 40B and a signal electrode drive circuit 20C having a different configuration are provided instead of a control circuit 40A and a signal electrode drive circuit 20B in FIG. 11. In addition, a multiplexer (hereinafter, referred to as a MUX) 80 is provided. The control circuit 40B has a configuration where the control circuit 40B has a function to output a control signal S40B (FIG. 15) corresponding to an arrangement of RGB of sub-pixels of the liquid crystal panel 10 in addition to a function of the control circuit 40A. The MUX 80, as shown in FIG. 15, selects a color correction voltage V60 for each RGB (VrR, VrG, VrB), based on the control signal S40B so as to correspond to a arrangement of RGB of the sub-pixels of the liquid crystal panel 10, and outputs color correction voltage V80 (VA, VB, VC) to the signal electrode drive circuit 20C. Other parts of the configuration are the same as that of FIG. 11.

Figure 16:
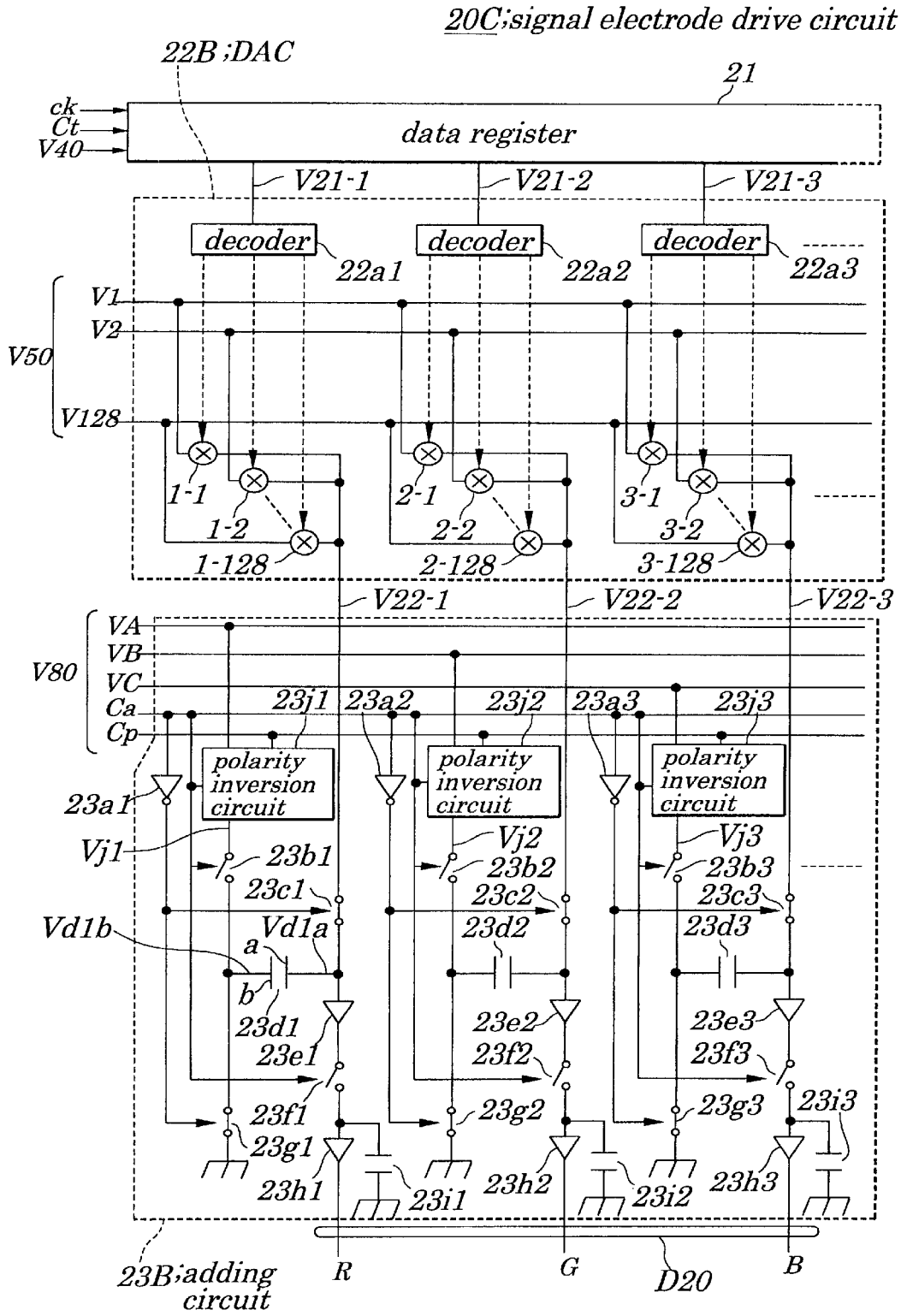
FIG. 16 is a circuit diagram showing an electrical configuration of a signal electrode drive circuit 20C in FIG. 14.

FIG. 16 is a circuit diagram showing an electrical configuration of the signal electrode drive circuit 20C in FIG. 14.

Although the signal electrode drive circuit 20C, as shown in FIG. 14, is the electrical configuration similar to the signal electrode drive circuit 20B, it is different in a point where the color correction voltage V80 is input to an adding circuit 23B.

FIG. 17 is a graph explaining an operation of the MUX 80.

The operation of the liquid crystal display device of FIG. 14 will be described with reference to FIG. 17.

In the liquid crystal display device, the control signal S40B corresponding to the arrangement of RGB of each color filter is output from the control circuit 40B even in a case where the color filters of the liquid crystal panel 10 are not only of the vertical-stripe type, the mosaic type and the triangle type but also in the horizontal-stripe type. The control signal S40B is input to the MUX 80, the color correction voltage V80 for each of RGB is selected from the MUX 80 so as to correspond to the arrangement of RGB of the color filter and the selected color correction voltage V80 is output to the signal electrode drive circuit 20C.

In this case, as shown in FIG. 17, when the control signal S40B corresponds to the color filter of the vertical-stripe type, the color correction voltage V60 (VA, VB, VC) corresponding to the vertical-stripe type is output from the MUX 80 and sent to the signal electrode drive circuit 20C. When the control signal S40B corresponds to the color filter of the mosaic type, the color correction voltage V60 (VA, VB, VC) corresponding to the mosaic type is output from the MUX 80 and sent to the signal electrode drive circuit 20C. When the control signal S40B corresponds to the color filter of the horizontal-stripe type, the color correction voltage V60 (VA, VB, VC) corresponding to the horizontal-stripe type is output from the MUX 80 and sent to the signal electrode drive circuit 20C. Thereafter, operation similar to the third embodiment is performed.

As described above, in the fourth embodiment, the control circuit 40B for outputting the control signal S40B corresponding to the arrangement of RGB of the sub-pixel and the MUX 80 for selecting and outputting the color correction voltage V60 of each of RGB so as to correspond to the arrangement of RGB of the sub-pixel of the liquid crystal panel 10, based on the control signal S40B are provided. Accordingly, in addition to the advantages of the third embodiment, the fourth embodiment can be applied to various color filters.

It is apparent that the present invention is not limited to the above embodiments but may be changed and modified without departing from the scope and spirit of the invention.

For example, the color filters are not limited to the three colors of RGB, but may be four colors (for example, including cyan or a like) for example. Moreover, the polarity inversion of the color correction voltage is not limited to the inversion in one horizontal line period, but may be the inversion in two horizontal line periods. Further, the control circuit 40B and the MUX 80 in FIG. 14 showing the fourth embodiment may be provided in FIG. 1, FIG. 3 or FIG. 11 showing other embodiments.

What is claimed is:

1. A liquid crystal display device, comprising:

a liquid crystal panel having a plurality of data signal lines for receiving a sub-pixel data signal corresponding to sub-pixel where a pixel is divided into three primary colors of red, green, and blue, a plurality of scanning signal lines for receiving a scanning signal, and a plurality of sub-pixel regions provided at points where each of said data signal lines and each of said scanning signal lines intersect, and said liquid crystal panel displaying a color image corresponding to said sub-pixel data signal by supplying said sub-pixel data signal to a sub-pixel region selected by said scanning signal among said plurality of sub-pixel regions;

a gradation voltage generation circuit for generating a plurality of a gradation voltages to give gradation to said sub-pixel data signal;

a color correction voltage generation circuit for generating a color correction voltage for each of said red, green, and blue based on a given signal for color correction;

a display signal circuit for selecting a gradation voltage corresponding to a gradation value of an image signal for said each of said red, green, and blue from said each gradation voltage, adding said color correction voltage for said each of said red, green, and blue respectively to said gradation voltage to generate said sub-pixel data signal, and sending said sub-pixel data signal to said each data signal line of said liquid crystal panel;

a scanning signal circuit for sending said scanning signal to said each scanning signal line of said liquid crystal panel synchronously with a clock signal; and a control circuit for outputting said clock signal and said image signal for said each of said red, green, and blue.

2. A liquid crystal display device, comprising:

a liquid crystal panel having a plurality of data signal lines for receiving a sub-pixel data signal corresponding to a sub-pixel where a pixel is divided into three primary colors of said red, green, and blue, a plurality of scanning signal lines for receiving a scanning signal, and a plurality of sub-pixel regions provided at points where each of said data signal lines and each of said scanning signal lines intersect, and said liquid crystal panel displaying a color image corresponding to said sub-pixel data signal by supplying said sub-pixel data signal to a sub-pixel region selected by said scanning signal among said plurality of sub-pixel regions;

a gradation voltage generation circuit for generating a plurality of gradation voltages to give gradation to said sub-pixel data signal, inverting a polarity of said gradation voltage in one frame period based on a polarity inversion signal, and outputting said gradation voltage with said inverted polarity;

a color correction voltage generation circuit for generating a color correction voltage for each of said red, green, and blue based on a given input signal for color correction, inverting a polarity of said color correction voltage in one frame period based on said polarity inversion signal, and outputting said color correction voltage with said inverted polarity;

a display signal circuit for selecting a gradation voltage corresponding to a gradation value of an image signal for said each of said red, green, and blue from said each gradation voltage, adding said color correction voltage for said each of said red, green, and blue respectively to said gradation voltage to generate said sub-pixel data signal, and sending said sub-pixel data signal to said each data signal line of said liquid crystal panel;

a scanning signal circuit for sending said scanning signal to said each scanning signal line of said liquid crystal panel synchronous with a clock signal; and a control circuit for outputting said clock signal and said image signal for said each of said red, green, and blue.

3. A liquid crystal display device, comprising:

a liquid crystal panel having a plurality of data signal lines for receiving a sub-pixel data signal corresponding to a sub-pixel where a pixel is divided into three primary colors of said red, green, and blue, a plurality of scanning signal lines for receiving a scanning signal, and a plurality of sub-pixel regions provided at points where each of said data signal lines and each of said scanning signal lines intersect, and said liquid crystal panel displaying a color image corresponding to said sub-pixel data signal by supplying said sub-pixel signal to a sub-pixel region selected by scanning signal among said plurality of sub-pixel regions;

a gradation voltage generation circuit for generating a plurality of gradation voltages to give gradation to said sub-pixel data signal, inverting a polarity of said gradation voltage in a specified number of horizontal line periods based on a polarity inversion signal, and outputting said gradation voltage with said inverted polarity;

a color correction voltage generation circuit for generating a color correction voltage for said each of said red, green, and blue based on a given input signal for color correction;

a polarity inversion circuit for inverting a polarity of said color correction voltage for said each of said red, green, and blue in a specified number of horizontal line periods based on said polarity inversion signal, and outputting said color correction voltage with said inverted polarity;

a displaying signal circuit for selecting a gradation voltage corresponding to a gradation value of an image signal for said each of said red, green, and blue from said each gradation voltage, adding said color correction voltage for said each of said red, green, and blue respectively to said gradation voltage to generate said sub-pixel data signal, and sending said sub-pixel data signal to said each data signal line of said liquid crystal panel;

a scanning signal circuit for sending said scanning signal to said each scanning signal line of said liquid crystal panel synchronously with a clock signal; and a control circuit for outputting said clock signal, said image signal for said each of said red, green, and blue and said polarity inversion signal.

4. A liquid crystal display device, comprising:

a liquid crystal panel having a plurality of data signal lines for receiving a sub-pixel data signal corresponding to a sub-pixel where a pixel is divided into three primary colors of said red, green, and blue, a plurality of scanning signal lines for receiving a scanning signal, and a plurality of sub-pixel regions provided at points where each of said data signal lines and each of said scanning signal lines intersect, and said liquid crystal panel displaying a color image corresponding to said sub-pixel data signal by supplying said sub-pixel data signal to a sub-pixel region selected by said scanning signal among said plurality of sub-pixel regions;

a gradation voltage generation circuit for generating a plurality of gradation voltages to give gradation to said pixel data signal;

a color correction voltage generation circuit for generating a color correction voltage for each of said red, green, and blue based on a given input signal for color correction;

a display signal circuit for selecting a gradation voltage corresponding to a gradation value of an image signal for said each of said red, green, and blue from said each gradation voltage, inverting said color correction voltage for said each of red, green, and blue at said each sub-pixel based on a polarity inversion signal and adding said color correction voltage with said inverted polarity to said gradation voltage to generate said sub-pixel data signal, and sending said sub-pixel data signal to said each data signal line of said liquid crystal panel;

a scanning signal circuit for sending said scanning signal to said each scanning signal line of said liquid crystal panel synchronously with a clock signal; and a control circuit for outputting said clock signal, said image signal for said each of said red, green, and blue and said polarity inversion signal.

5. A liquid crystal display device, comprising:

a liquid crystal panel having a plurality of data signal lines for receiving a sub-pixel data signal corresponding to a sub-pixel where a pixel is divided into three primary colors of said red, green, and blue, a plurality of scanning signal lines for receiving a scanning signal, and a plurality of sub-pixel regions provided at points where each of said data signal lines and each of said scanning signal lines intersect, and said liquid crystal panel displaying a color image corresponding to said sub-pixel data signal by supplying said sub-pixel data signal to a sub-pixel region selected by said scanning signal among said plurality of sub-pixel regions;

a gradation voltage generation circuit for generating a plurality of gradation voltages to give gradation to said sub-pixel data signal;

a color correction voltage generation circuit for generating a color correction voltage for said each of said red, green, and blue based on a given input signal for color correction;

a multiplexer for selecting and outputting said color correction voltage for said each of said red, green, and blue in accordance with an arrangement of said red, green, and blue color filters in a horizontal direction of said sub-pixels on said liquid crystal panel, based on a control signal;

a display signal circuit for selecting a gradation voltage corresponding to a gradation value of an image signal for said each of said red, green, and blue from each gradation voltage, adding said color correction voltage for said each of said red, green, and blue output from said multiplexer respectively to said gradation voltage to generate said sub-pixel data signal, and sending said sub-pixel data signal to said each data signal line of said liquid crystal panel;

a scanning signal circuit for sending said scanning signal to said each scanning signal line of said liquid crystal panel synchronously with a clock signal; and a control circuit for outputting said clock signal, said image signal for said each of said red, green, and blue and said control signal.

* * * * *